US005400535A

United States Patent [19]

Schomaker

[11] Patent Number: 5,400,535

[45] Date of Patent: Mar. 28, 1995

[54] TEMPORARY SIGN

[76] Inventor: Michael B. Schomaker, 1763 Gabbro Trail, Eagan, Minn. 55122

[21] Appl. No.: 159,680

[22] Filed: Nov. 30, 1993

[51] Int. Cl.[6] ..... G09F 15/00
[52] U.S. Cl. ..... 40/607; 40/611
[58] Field of Search ..... 40/606, 607, 605, 611; 403/363, 375; 248/214, 224.4

[56] References Cited

U.S. PATENT DOCUMENTS

| | | | |
|---|---|---|---|
| 1,068,391 | 7/1913 | Jensen | 248/214 |
| 1,238,976 | 9/1917 | Zika | 40/607 |
| 4,094,487 | 6/1978 | Heard | 40/607 X |
| 4,910,901 | 3/1990 | Boyar | 40/607 |
| 4,951,906 | 8/1990 | Morey | 40/607 X |
| 5,188,333 | 2/1993 | Schumacher et al. | 248/224.4 X |
| 5,230,176 | 7/1993 | Schomaker | 40/607 |

FOREIGN PATENT DOCUMENTS

| | | | |
|---|---|---|---|
| 864808 | 3/1971 | Canada | 40/607 |

*Primary Examiner*—Kenneth J. Dorner
*Assistant Examiner*—Joanne Silbermann
*Attorney, Agent, or Firm*—Nawrocki, Rooney & Sivertson

[57] ABSTRACT

An improvement for temporary signs used with a supporting post and an arm which extends both directions from the post. A first and second body, shaped to fit around three sides of post and the arm respectively, have inwardly inclined opposed sides to grip the enclosed post or arm. An extension along the spine has an opening oriented and shaped to fit over the post for the first body, and an extension along the spine has an opening oriented and shaped to fit over the short end of the arm for the second body. When mounted in place, the extension for the first body has a slot which extends opposite the end of the second body, and the second body has an extension which fits into the first body slot. This combination of inclined sides, openings over the respective post and arm, and the interlocked bodies holds the two bodies securely in place. Slots in the bodies along the spines receive a T-shaped bracket which has a bifurcated extension which extends through these slots. These bifurcated extensions grip a sign with no additional apparatus being required. An optional box can be attached to the first body to hold printed information.

5 Claims, 3 Drawing Sheets

TEMPORARY SIGN

FIELD OF THE INVENTION

This invention relates to temporary signs of the type used in conjunction with a permanent brokerage sign to indicate the individual realtor and sales status of real estate property to the public.

Background of the Invention

My previous U.S. Pat. No. 5,230,176 addressed attaching temporary signs to a post and arm where the arm extended from one side of the post only. In my previous patent, temporary signs were bolted to a bracket mounted on bodies which were fitted around three sides of the post or arm and held in position by flexible members around the fourth side. Changing signs in the field required considerable time since the signs had to be unbolted from the brackets and new signs bolted in their place. This invention for attaching temporary signs is intended for use where the arm extends from both sides of the post. This is desirable because a large number of realtors in the United States use a post with an arm which extends outward perpendicularly from the upper portion of the post in both directions to display temporary signs relating to property being sold at that site. In addition, in previous inventions no provisions have been made to provide written material describing the property as part of the sign. My present invention provides a simplified method of attaching temporary signs to a post and arm where the arm extends in both directions, which requires no flexible member to secure the bodies to the post or arm, which permits ready substitution of signs in the field, and which also provides an option of providing printed sales information as a part of the temporary sign.

SUMMARY OF THE INVENTION

The sides of bodies, each of which hold a temporary sign, are inclined inward to grip a respective enclosed post or arm. Each body has an extension with an opening sized to fit over the end of the adjacent arm or post when mounted in place. One body has a slot on the extreme end of the extension and the other body has an extension which extends within the slot when the bodies are in place on the sign. This interlocks the two bodies and holds them closely against their respective enclosed arm or post to grip the enclosed part tightly. The combination of the inclined sides, the openings positioned over the adjacent arm or post, and the interlocking of the two bodies holds them securely in place with no flexible member being required.

Here the signs are not attached to the bodies by being bolted in place but are gripped within T-shaped brackets. The outer portion of these brackets extend outward through slots in the bodies. This portion is bifurcated to grip and hold a sign against the body. This eleminates bolting signs in place on the bodies. This arrangement allows ready substitution of new signs in the field merely by sliding one sign outward from within the bifurcated extension from the T-shaped bracket and sliding another one into that position.

A further improvement to the sign provides a box arranged to be attached to the body is mounted on the arm. This box has an opening to permit placing printed information relating to the property within the box out of the weather. This box is attached to the body by hand which permits adding this option on site.

DETAILED DESCRIPTION OF THE DRAWINGS

DETAILED DESCRIPTION OF THE PREFERRED EMBODIMENTS

Figure 1:
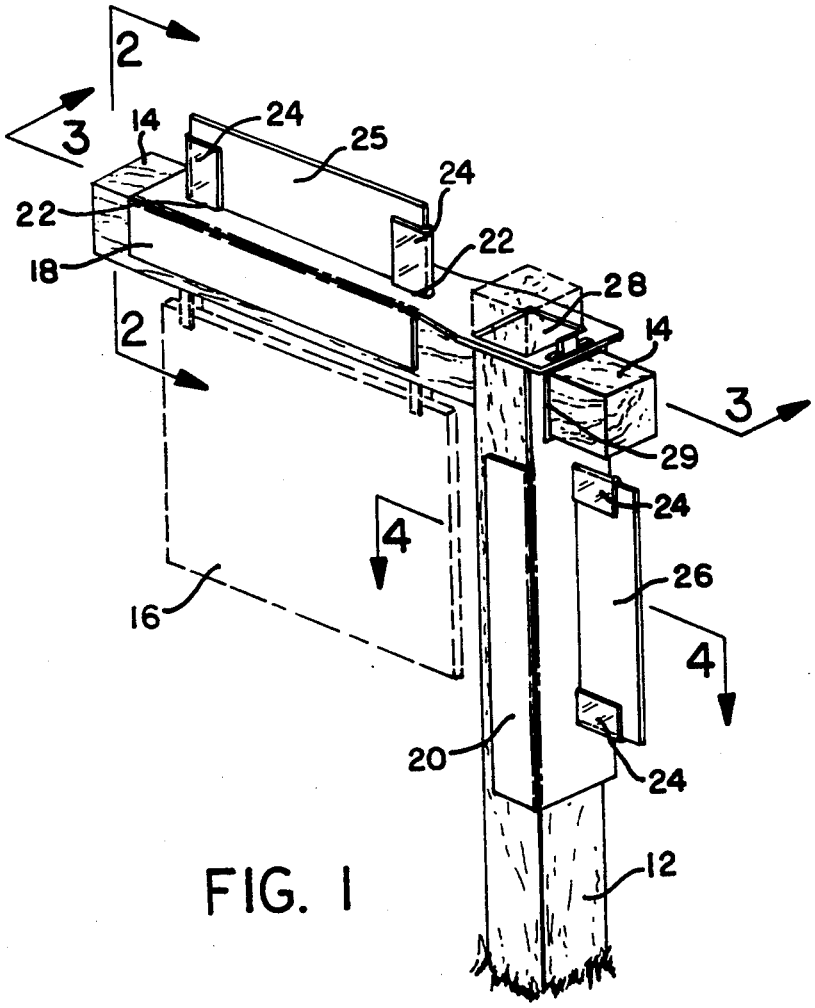
FIG. 1 is an isometric view of a post holding an arm, showing a permanently mounted first sign beneath the arm in dashed outline, showing a first body supporting a second sign attached to the arm, and showing a second body supporting a third sign attached to the post.
Figure 2:
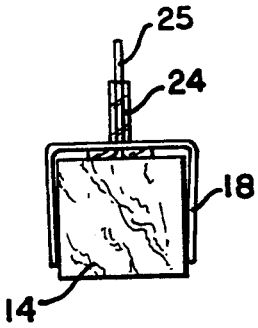
FIG. 2 is a cross-section taken along 2—2 of FIG. 1.

As shown in FIGS. 1, 2, 3 and 4, post 12 supported in the ground in a vertical orientation, has an arm 14 attached to the post extending outwardly horizontally in both directions from the post. A permanently mounted first sign 16, shown in dashed outline, is secured under one end of arm 14 using brackets. First sign 16 is not part of the invention but is included to show the relationship between the sign and the mounting of the temporary signs which are part of this invention.

U-shaped first body 18, formed of rigid material with a U-shaped cross-section having a central spine at right angles to two opposing limbs, is positioned and sized to fit over and around the longer portion of arm 14. Second body 20 is similarly fashioned to fit over and around the lower end of post 12. The spine of both are sized to extend partially across the respective top surfaces with the limbs extending partially down the respective side surfaces. Slots 22 through first body 18 and second body 20 provide an opening for T-shaped sign holding brackets 24.

Brackets 24 have two bifurcated extensions which extend upward through slots 22, obtained by folding a single sheet of material around the sign ends. The opposite ends of the material are bent outward to form the base of a T which prevents brackets 24 from passing outward through slots 22, to hold the signs perpendicular to the spine of the brackets. The upward bifurcated folded portions are arranged to press against each other to hold second sign 25 and third sign 26. Brackets 24 are preferably made of transparent plastic material which has both transparency and spring-like characteristics. Brackets 24 can be made of non-transparent material but then the information on the sign can not be positioned under the brackets which would reduce the effective size of the sign.

Figure 1A:
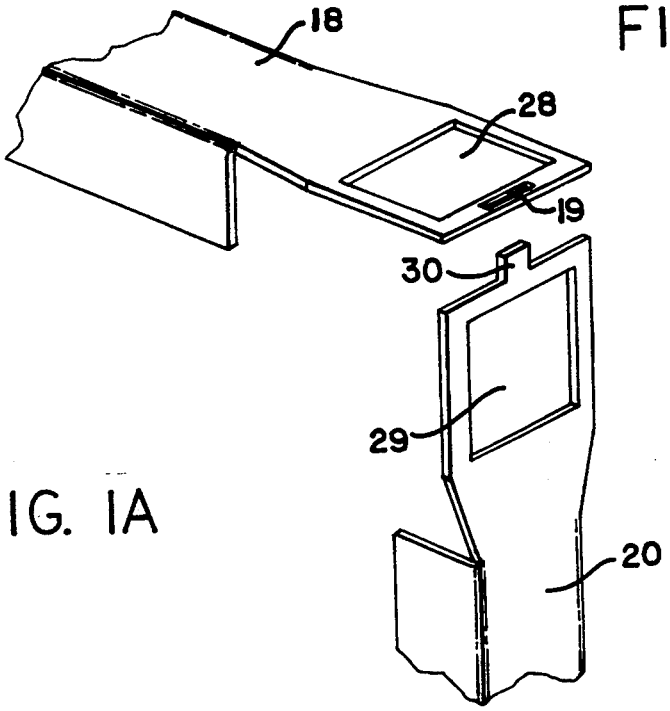
FIG. 1A is an isometric detail showing the adjacent ends of the first body and the second body and their attachment means.
Figure 3:
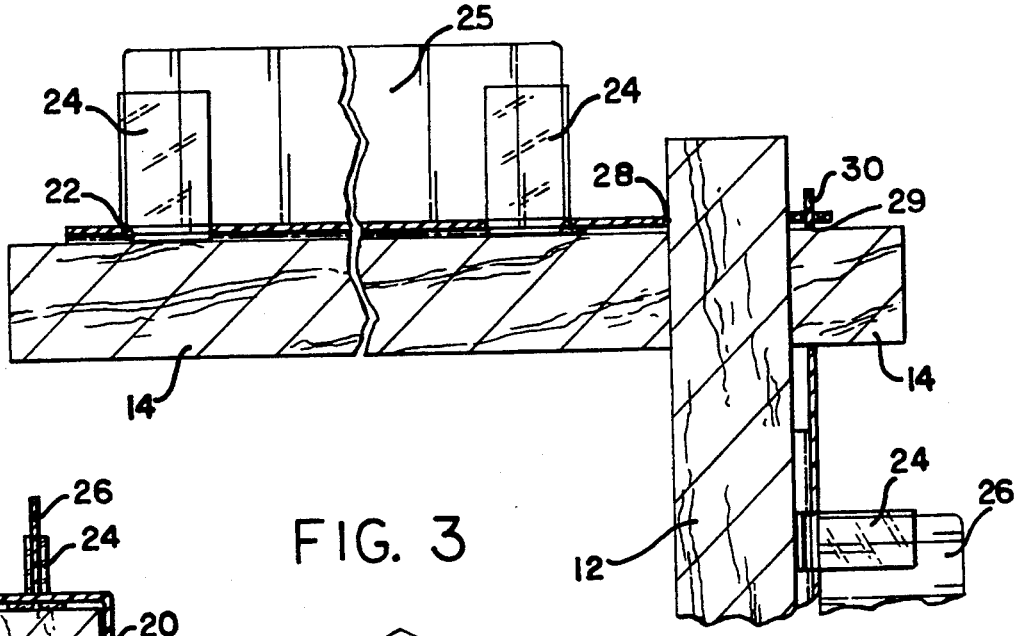
FIG. 3 is a cross-section taken along 3—3 of FIG. 1.
Figure 4:
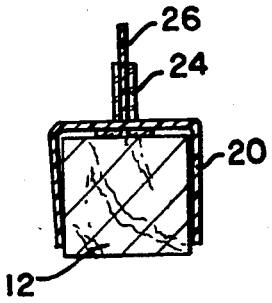
FIG. 4 is a cross-section taken along 4—4 of FIG. 1

First body 18 has an extension between the spine containing an opening 28 which is oriented and sized to fit over the top of post 12. This extended part, also shown in FIG. 1A, contains a slot 19 in its extreme end. Second body 20 also has an extension between the spine containing an opening 29, sized and oriented to fit around the short end of arm 14, ending in a projection 30 which is sized to fit within slot 19. As shown more clearly in FIGS. 2 and 4, opposing sides of bodies 18 and 20 incline inwardly to provides a gripping force on arm 14 and post 12 respectively. As can be seen in FIGS. 1A and 3, projection 19 in extending through slot 30 will lock the first body 18 with respect to second body 28 which will hold the bodies tightly against their respective enclosed post 12 and arm 14. First body 18 is also held downward against arm 14 by gravity. This locking the two bodies in place relative to each other, along with their inwardly inclined sides griping a substantial part of the respective opposed arm or post, is all that is required to secure them in place.

Figure 5:
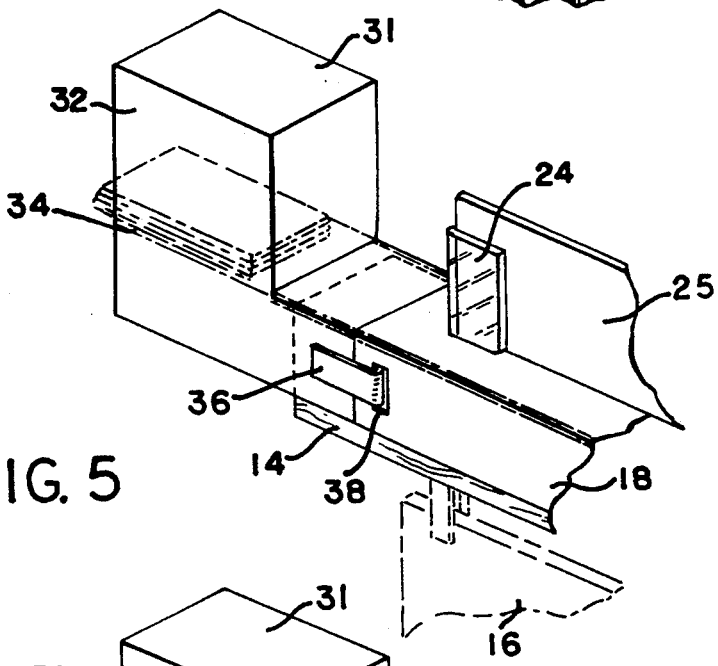
FIG. 5 is an isometric view of detail of a box and the adjacent end the first body showing the box first attachment means.

In FIGS. 5, 6, 7 and 8, box 31 with open end 32 and floor 34, is shown secured over the outer end of arm 14 either near or over the adjacent end of first body 18. In FIG. 5 box 31 has projections 36 attached to opposite sides of box 31 which engage matching slots 38 in first body 18, when the box is placed in the relationship adjacent to first body 18 as shown.

Figure 6:
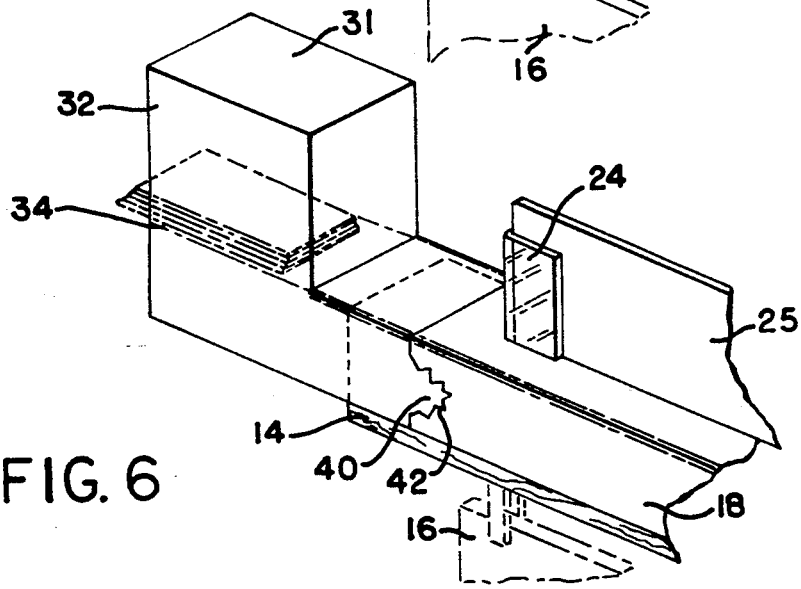
FIG. 6 is the view of FIG. 5 showing the box second attachment means.

In FIG. 6, the end of box 18 has serrated projection 40 formed on opposite sides of the box which engage mating serrated cut-outs 42 in the in first body 18 as shown, when the box is placed adjacent to first body 18.

Figure 7:
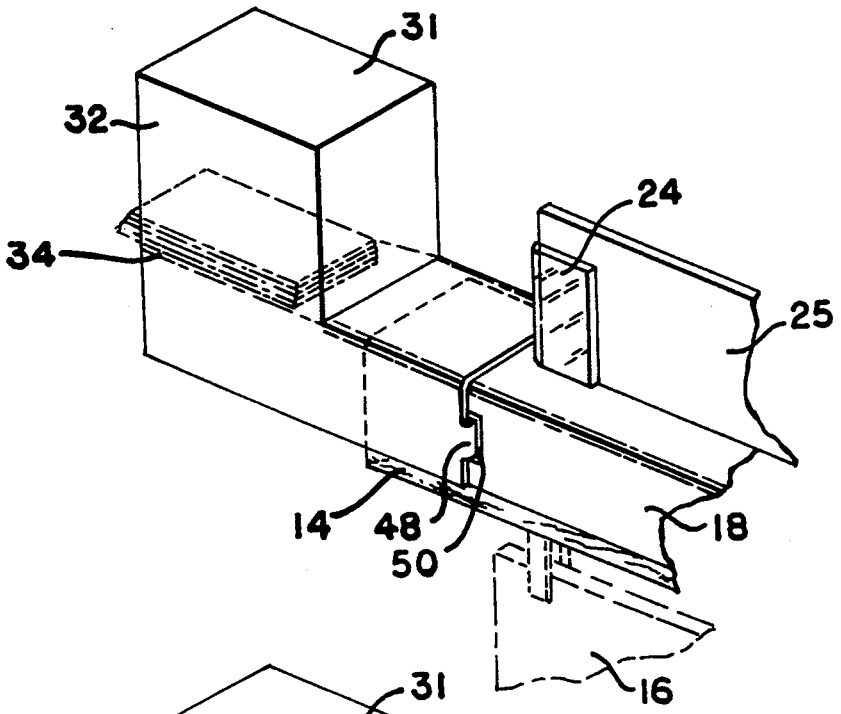
FIG. 7 is the view of FIG. 5 showing the box third attachment means.

In FIG. 7, the end of box 31 has an extension 48 which engages and fits into slot 50 in first body 18 as shown, when the box is placed over the end of the first body.

Figure 8:
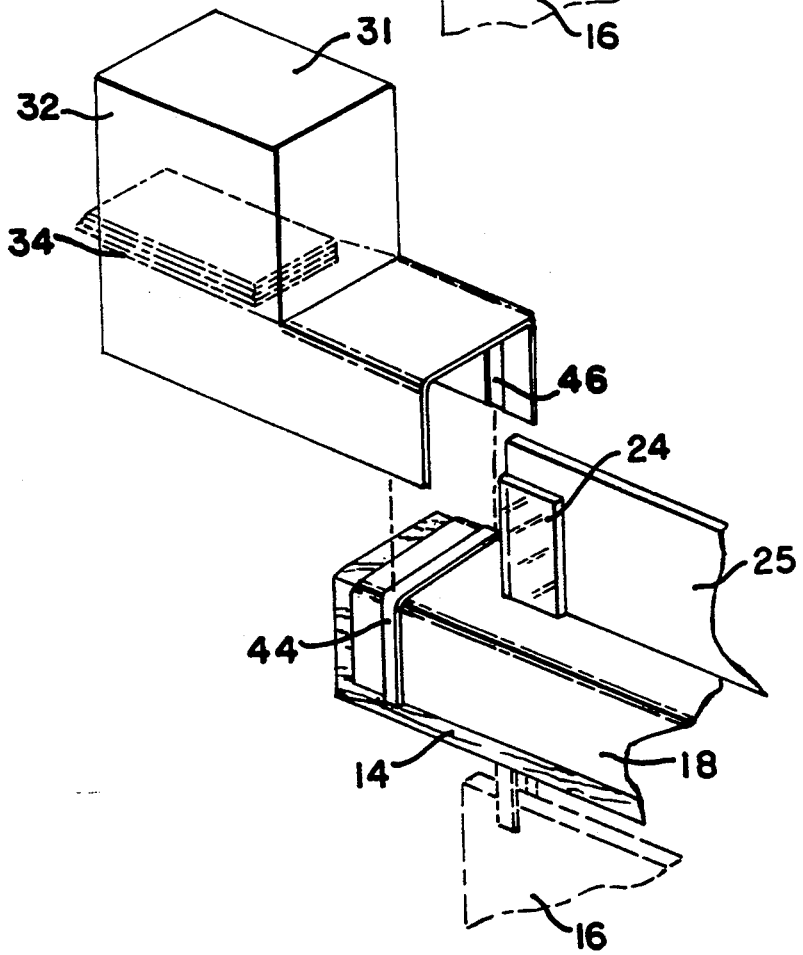
FIG. 8 is the view of FIG. 5 showing the box fourth attachment means.

In FIG. 8, the end of box 31 has a ridge 44 around the outer end of the box which fits within a matching recess 46 around the sides of first body 18, when the box is placed as shown downward over the end of the first body as shown.

To secure a sign in place the bifurcated portion of brackets 24 are extended through slots 22 in first body 18 and second body 20 from the side of the adjacent to the respective body. Signs 25 and 26 are then slid into place within the bifurcated portions of brackets 24 which holds them adjacent to the respective bodies.

First body 18 is then mounted around the top of arm 14 with opening 28 over the end of post 12. Second body 20 is then mounted over the side of post 12 with opening 29 mounted over the short end of arm 14. The portion of first body 18 containing extension 19 is held outward until second body 20 is in place and released with extension through slot 30, as shown in FIG. 1. The bodies and signs can be removed by essentially reversing this procedure.

Box 31 is mounted in place by placing the box in the position shown in FIGS. 5 through 8. In FIG. 5, projection 36 will extend within slot 38 when box 31 is positioned as shown.

In FIG. 6, projection 40 must be pressed within cut-out 42 after box 31 is in position. In FIG. 7, extension 48 will also extend within slot 50 when box 31 is in the position shown.

In FIG. 8 box 31 must be slid over the top of first body 18 to the position shown. Again, the boxes can be removed by reversing these procedures.

Signs can be changed by merely sliding the old sign from within the brackets holding them in place and sliding a substitute into the brackets.

These temporary sign improvements reduce the number of parts needed to secure temporary signs in place while still holding them securely in position by taking advantage of the shape of the post with two extensions. Signs can be substituted readily and quickly in the field with no tools being required. A box to hold information pertaining to the property can be added in the field , if desired, with no tools being required.

While two brackets were shown in these embodiments other arrangements are possible. For example, if transparent material is used for the brackets then one longer centrally located bracket rather than two can be used to support the sign. Conversely more than two brackets can be used. The projection from the second body and the mating slot in the first body can also be interchanged. Further, all of the parts or only selected parts can be made of either plastic or metal. If metal is used for the brackets then the signs must be arranged such that the brackets do not cover any sign information, as was discussed earlier.

While this invention has been described with reference to illustrative embodiments, these descriptions are not intended to be construed in a limiting sense. Various modifications of the illustrative embodiment, as well as other embodiments of the invention, will be apparent to persons skilled in the art upon reference to these descriptions. It is therefore contemplated that the appended claims will cover any such modifications or embodiments as fall within the true scope of the invention.

I claim:

1. Temporary sign supporting apparatus comprising:

(a) a sheet of rigid material formed into a body with an open U-shape having a central spine and opposed planar limbs of generally equal size with the opposed limbs being inclined inward towards each other; and (b) the spine of said body having a first extension extending outward from one end of said body beyond and between said limbs, said first extension having a generally rectangular shaped opening of a predetermined size with two of the sides of said opening being parallel to the sides of the extension; and (c) a sign having a predetermined length and width which is attached perpendicularly to the spine of said body with the length of the sign parallel to the limbs of the body and the sign being attached to the side of the spine opposite the open U-shape.

2. Apparatus as in claim 1 having sign attachment means for attaching said sign to said body comprising:

(a) at least one bracket, said bracket having an elongated generally rectangular shaped base with a length no greater than the length of said body and a width less than the width of the spine of said body, the bracket having a bifurcated extension extending from one side of the base, the extension having a predetermined thickness and a preferable length no greater than the width of the sign, with the extension and the base being arranged such as to form a T-shape, and (b) said body having as many slots as brackets, said slots being of a predetermined width extending along the spine parallel to the limbs, the slot width being less than the width of the base of a bracket and greater than the thickness of the bracket extension.

3. Apparatus as in claim 2 and further comprising a slot in the end of the first extension of the first body and a projection from the end of the first extension of the second body which is sized to fit within the slot in the first extension when the first body is mounted on the arm with the rectangular opening in the extension over the end of the post and the second body mounted in the post with the rectangular opening in the extension over the end of the arm.

4. Aparatus as in claim 2 and further comprising:

(a) a box having a floor, an open end, a closed end, and a U-shaped extension which opens downward from the floor, said U-shaped extension also extending past the closed end of the box, the U-shaped extension being sized to fit over the top and around the sides of an extending supporting arm, said box having attachment means for attaching the box to the outward end of a body adjacent to the box on the arm of the post.

5. Apparatus as in claim 4 wherein said attachment means comprises:

(a) a projection from both sides of the U-shaped extension from said box which extends over the adjacent body; and (b) slots in the adjacent limbs of the adjacent body sized to receive the projection from the box.

* * * * *